US011752545B2

(12) United States Patent
Xu et al.

(10) Patent No.: US 11,752,545 B2
(45) Date of Patent: Sep. 12, 2023

(54) TESTING MACHINE FOR SIMULATING DIE-CASTING DIE COOLING PROCESS

(71) Applicant: ZHEJIANG UNIVERSITY, Hangzhou (CN)

(72) Inventors: Zhongbin Xu, Hangzhou (CN); Bin Xue, Hangzhou (CN); Qisen Liang, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 99 days.

(21) Appl. No.: 17/489,786

(22) Filed: Sep. 30, 2021

(65) Prior Publication Data

US 2022/0016696 A1 Jan. 20, 2022

Related U.S. Application Data

(63) Continuation of application No. PCT/CN2020/106598, filed on Aug. 3, 2020.

(51) Int. Cl.
*B22D 17/22* (2006.01)

(52) U.S. Cl.
CPC ..... *B22D 17/2218* (2013.01)

(58) Field of Classification Search
CPC ..... B22D 17/22; B22D 17/2218
USPC ..... 164/348, 122, 151.4, 154.6
See application file for complete search history.

(56) References Cited

U.S. PATENT DOCUMENTS

2011/0041582 A1* 2/2011 Kim et al. ..... B21C 23/085 72/253.1
2019/0283300 A1* 9/2019 Rethman et al. ..... B29C 48/92

FOREIGN PATENT DOCUMENTS

| | | | |
|---|---|---|---|
| CN | 101797634 | A | 8/2010 |
| CN | 102974703 | A | 3/2013 |
| CN | 104458474 | A | 3/2015 |
| CN | 107020366 | A | 8/2017 |
| CN | 110788295 | A | 2/2020 |
| EP | 3520987 | A1 | 8/2019 |
| JP | 2000313035 | A | 11/2000 |

OTHER PUBLICATIONS

International Search Report (PCT/CN2020/106598); dated Oct. 30, 2020.

* cited by examiner

*Primary Examiner* — Kevin P Kerns
(74) *Attorney, Agent, or Firm* — W&G Law Group

(57) ABSTRACT

Provided is a testing machine for simulating a die casting cooling process, including a mold base, a stationary die, a moving die, a guide rod, an ejector rod, a mold clamping device, a point cooling device housing, a cooling water channel, a heating coil, a heating block and a heating bar; a point cooling unit includes the point cooling device housing and the cooling water channel, a plurality of heating bars regularly arranged on the moving die constitute a pre-heating unit, a thermocouple is arranged at the point cooling unit, a temperature signal is connected to a controller, the heating coil and the heating block constitute an external heating unit, the point cooling unit is connected to a cooler, a cooling water tank, a filter and a water pump to constitute a cooling device, the controller and a ball valve constitute a control system.

7 Claims, 3 Drawing Sheets

TESTING MACHINE FOR SIMULATING DIE-CASTING DIE COOLING PROCESS

CROSS-REFERENCE TO RELATED APPLICATIONS

The present application is a continuation of International Application No. PCT/CN2020/106598, filed on Aug. 3, 2020, which claims priority to Chinese Application No. 201911090057.4, filed on Nov. 8, 2019, the contents of both of which are incorporated herein by reference in their entireties.

TECHNICAL FIELD

The present application relates to the simulation test technology for a die casting die cooling process, and in particular to a test machine for simulating a die casting die cooling process.

BACKGROUND

A die casting mold is critical equipment in the pressure casting industry, and it is not only critical factors affecting the die cast quality, but also determines the cost of die casting production. A set of well-maintained die casting mold with an extended life span can greatly reduce the cost of pressure casting production. Thermal fatigue cracking is a common form of failure of a die casting mold. The die casting mold is subjected to severe heating and cooling processes such as high temperature alloy liquid scouring, mold opening and mold closing and spraying a mold release during die casting production, and the production environments are very harsh. A die cooling device may better ameliorate the thermal fatigue and thermal shock issues encountered by the die casting mold, and thus is a strong guarantee for extending the life span of the die casting mold. For the design of the mounting position of a cooling duct of the die casting mold, numerical simulation results are usually used as a reference, which lacks actual experimental support, and the arrangement of cooling device is difficult to modify after installation due to the high production cost of the actual die casting mold. Designing a testing machine that can simulate the die casting cooling process can provide a reference for the arrangement of the cooling device of the die casting mold.

SUMMARY

In view of the deficiencies of the prior art, the present application aims to provide a test bench for simulating a cooling process of a die casting mold for evaluating simulated experimental effects of the cooling process of the die casting mold. The specific technical solution is as below:

A testing machine for simulating a die casting cooling process includes a mold, a cooling unit, a heating unit, a detection and control unit.

wherein the mold comprises a base, a stationary die, a moving die, a screw, an ejector rod device, a driving device and a heating block mounting box; the stationary die is fixed to the base, the moving die is located directly above the stationary die, a cavity in which the heating block mounting box is placed is provided on opposite faces of the moving die and the stationary die, the heating block mounting box is divided into two parts, i.e., an upper part and a lower part, embedded in the moving die and the stationary die, respectively, a cavity in which a heating block is placed is provided inside the heating block mounting box, an upper surface of the moving die is provided with an ejector rod through hole, a screw through hole, a heating bar mounting hole and a point cooling unit mounting hole, the screw extends through the moving die, with one end fixed to the stationary die and the other end fixed to the driving device, a top end of the ejector rod device is connected to the driving device and extends through the moving die and the upper part of the heating block mounting box;

the cooling unit comprises a cooler, a cooling water tank, a water pump, a valve and a point cooling unit, the point cooling unit is mounted in the point cooling unit mounting hole, and the point cooling unit, the cooler, the cooling water tank and the water pump are connected in sequence to form a cooling water circulation circuit;

the heating unit comprises an external heating module which comprises a heating block and a heating coil and an internal pre-heating module which comprises a heating bar mounted in the heating bar mounting hole;

the detection and control unit comprises a thermocouple mounted on a point cooling unit housing and a controller electrically connected to the thermocouple, the valve and the driving device to detect the temperature of each hot point on the moving die according to the thermocouple and to adjust opening and closing of the valve.

Furthermore, the cooling unit further comprises a filter arranged between the cooling water tank and the water pump.

Furthermore, a depth of the heating bar mounting hole is 50%-90% of a thickness of the moving die and a depth of the point cooling unit mounting hole is 60%-90% of a thickness of the moving die.

Furthermore, there are a plurality of heating bar mounting holes that are symmetrically and uniformly distributed on the upper surface of the moving die.

Furthermore, there are a plurality of point cooling unit mounting holes that are symmetrically and uniformly distributed on the upper surface of the moving die.

Furthermore, the heating block can be a tile-shaped, triangular prism-shaped, cuboid or spherical housing, and the cavity of the heating block mounting box in which the heating block is placed for the moving die and the stationary die fits the shape of the heating block.

A method for controlling the testing machine for simulating a die casting cooling process according to any one of the above solutions specifically includes the following steps of:

S1: preheating the moving die (4) to 150-180° C.;

S2: placing the heating block (9) in the heating coil (8) to heat for a certain period of time, placing the heated heating block (9) in the cavity of the stationary die (2), and the driving device (7) driving the moving die (4) for mold closing;

S3: the thermocouple (13) monitoring in real time the temperature of each measured point of the moving die (4), the cooling water circulation circuit cooling the moving die (4), calculating an average value of the temperature of each measured point, and the controller (18) controlling the driving device (7) to lift the moving die (4) along the screw (6) when the average value is lower than 200° C.; after the moving die (4) is raised to a highest position, the driving device (7) driving the ejector rod (5) to eject the heating block (9); thereby completing simulation of a die casting cooling process;

S4: repeating S1-S3 and recording an average $t_{im}$ of a thermocouple measurement point after completion of each simulation of the die cast cooling process; determining that the die cast cooling simulation process has reached a temperature equilibrium when an error of the average value relative to a previous average value is not greater than a set threshold, and recording the average value of the temperature at this time as $t_M$; ending the test and recording a total time for the simulation process;

S5: further judging whether temperatures of various hot points are uniformly distributed, i.e., whether a temperature difference extremum $\Delta t_{max}=\max|t_j-t_M|(j=1, 2, 3 \ldots 6)$ is less than a set threshold; if the temperature difference is less than or equal to the set threshold, determining that the temperatures are relatively uniformly distributed and the cooling effect is good, and recording a total time T for a heating-cooling process as a basis for determining the cooling effect; if the temperature difference extremum $\Delta t_{max}$ is greater than the set threshold, determining that the cooling condition is poor and the current cooling solution is not good enough;

S6: comparing a total heating-cooling cycle time T for a plurality of cooling solutions with the temperature difference extremum $\Delta t_{max}$ less than the set threshold, wherein the cooling solution with a smallest T is an optimal solution.

The beneficial effects of the present application are as follows:

Compared with an actual die casting mold, the simulation testing machine for simulating the die casting cooling process of the present application has an adjustable cooling site and a variable shape of the heating block, and thus can realize simulation tests on different die casting cooling processes.

Figure 1:
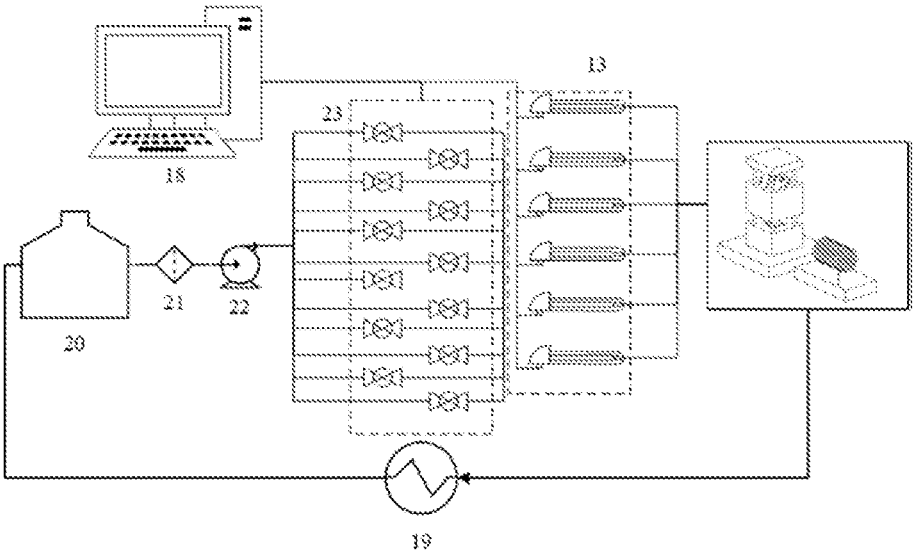
FIG. 1 is a schematic diagram of the overall structure of the simulation testing machine for a die casting mold cooling process according to the present application.
Figure 2:
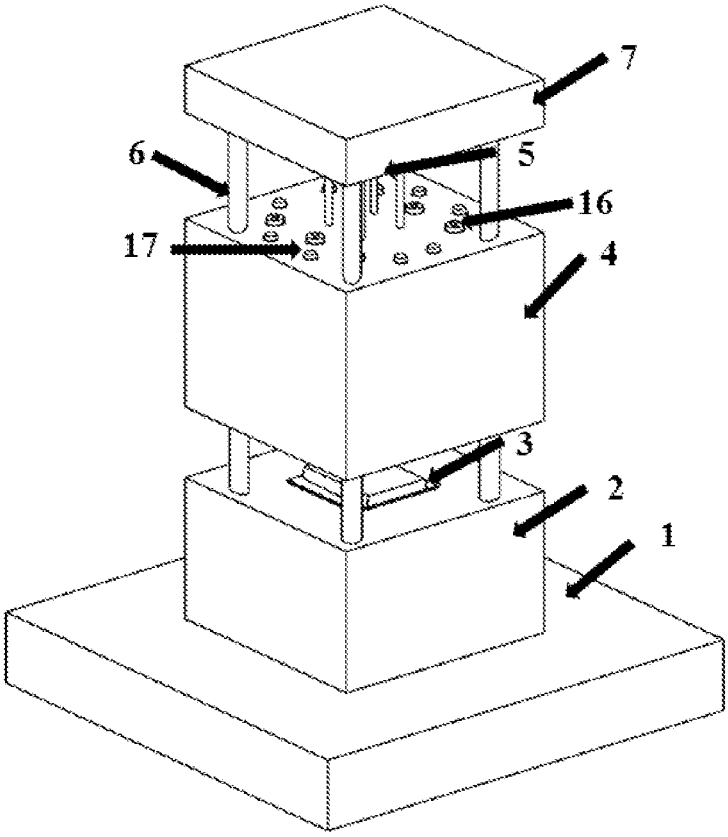
FIG. 2 is a schematic diagram of the die assembly structure of the simulation testing machine for a die casting mold cooling process according to the present application.
Figure 3:
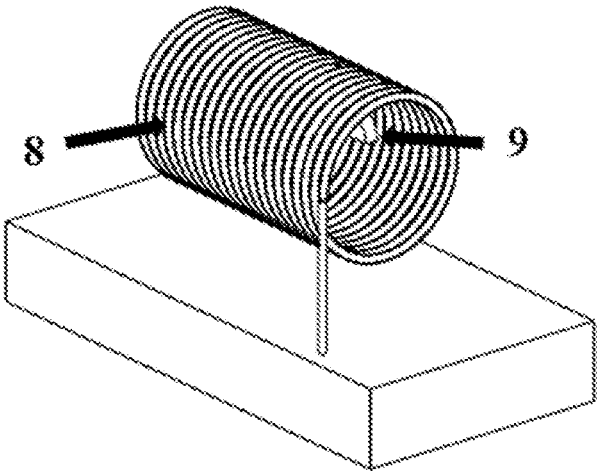
FIG. 3 is a schematic diagram of an external heating unit of the present application.
Figure 4:
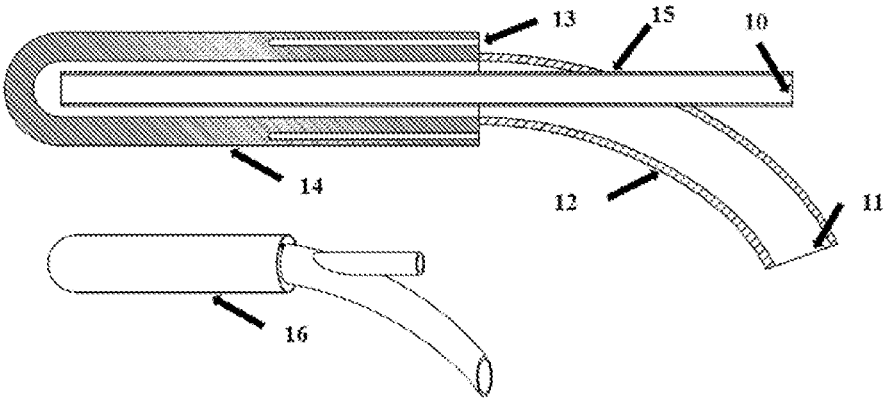
FIG. 4 is a structural schematic diagram of the point cooling unit according to the present application.
Figure 5:
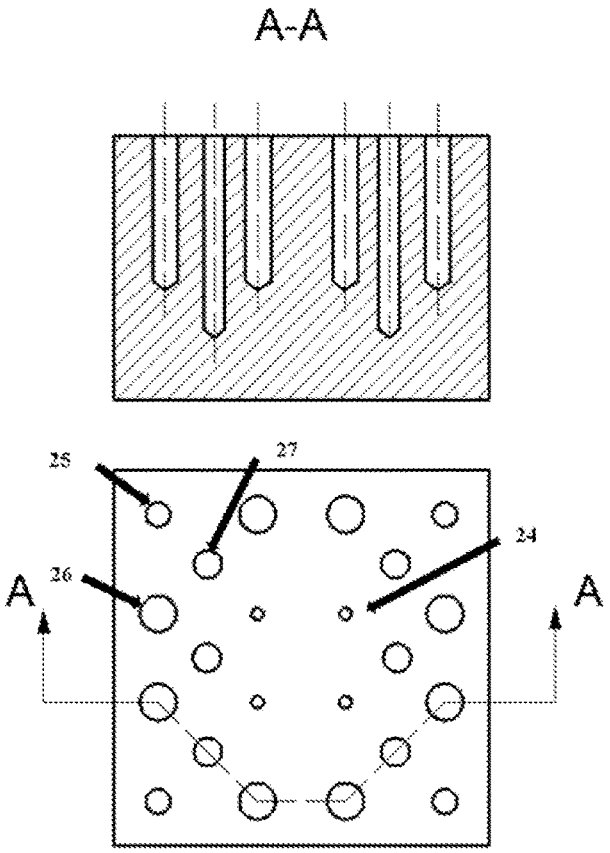
FIG. 5 is a sectional view and a top view of the moving die.

Reference Signs: base 1, stationary die 2, heating block mounting box 3, moving die 4, ejector rod device 5, screw 6, driving device 7, heating coil 8, heating block 9, cooling water inlet 10, cooling water outlet 11, cooling water pipe 12, thermocouple 13, point cooling device housing 14, insulating layer 15, point cooling unit 16, the heating bar 17, controller 18, cooler 19, cooling water tank 20, filter 21, water pump 22, ball valve 23, ejector rod through hole 24, screw through hole 25, heating bar mounting hole 26, point cooling unit mounting hole 27.

DESCRIPTION OF EMBODIMENTS

The objects and effects of the present application will become more apparent from the following detailed description of the present application in view of the accompanying drawings and preferred embodiments, in conjunction with which the present application will be described in further detail below. It should be understood that the specific embodiments described herein are merely illustrative of the application and are not intended to be limiting of the application.

As shown in FIGS. 1-5, the testing machine for simulating a die casting cooling process of the present application includes a mold, a cooling unit, a heating unit, a detection and control unit;

wherein the mold comprises a base 1, a stationary die 2, a moving die 4, a screw 6, an ejector rod device 5, a driving device 7 and a heating block mounting box 3; the stationary die 2 is fixed to the base 1, the moving die 4 is located directly above the stationary die 2, a cavity in which the heating block mounting box 3 is placed is provided on opposite faces of the moving die 4 and the stationary die 2, the heating block mounting box 3 is divided into two parts, i.e., an upper part and a lower part, embedded in the moving die 4 and the stationary die 2, respectively, a cavity in which a heating block 9 is placed is provided inside the heating block mounting box 3, an upper surface of the moving die 4 is provided with an ejector rod through hole 24, a screw through hole 25, a heating bar mounting hole 26 and a point cooling unit mounting hole 27, the screw 6 extends through the moving die 4, with one end fixed to the stationary die 2 and the other end fixed to the driving device 7, a top end of the ejector rod device 5 is connected to the driving device 7 and extends through the moving die 4 and the upper part of the heating block mounting box 3.

The cooling unit includes a cooler 19, a cooling water tank 20, a water pump 22, a valve 23 and a point cooling unit 16, the point cooling unit is mounted in the point cooling unit mounting hole 27, and the point cooling unit 16, the cooler 19, the cooling water tank 20 and the water pump 22 are connected in sequence to form a cooling water circulation circuit; the outlet of the water pump 22 is connected to multiple pipelines, each pipeline is provided with a valve 23, and each pipeline is connected to a point cooling unit 16; after cooling water flows out of the experimental table, it passes through the cooler 19, cools to room temperature, and flows into the cooling water tank 20 for multiple recycling. The cooling water is pumped out of the cooling water tank 20 by the water pump 22, and is then filtered through the filter 21 for the subsequent cooling process.

The point cooling unit 16 includes a cooling water inlet 10, a cooling water outlet 11, a cooling water pipe 12, a thermocouple 13, a point cooling device housing 14 and an insulating layer 15. The insulating layer 15 is arranged outside the cooling water inlet pipe. Cooling water enters from the cooling water inlet 10, flows through an annular channel formed by the point cooling device housing 14 and the cooling water inlet pipe, and flows out through the cooling water outlet 11 of the cooling water pipe 12. The insulating layer 15 is made of a thermal insulation material to reduce the heat exchange effect between the initial inlet cooling water and the heated outlet cooling water. The cooling water pipe 12 and the point cooling device housing 14 are made of thermally conductive metal materials to ensure the heat exchange effect. The thermocouple 13 is arranged in the middle of the thickness of the point cooling device housing for measuring the temperature value of the point.

The heating unit includes an external heating module comprising a heating block (9) and a heating coil (8) and an internal pre-heating module comprising a heating bar (17) mounted in the heating bar mounting hole (26) of the moving die 4; there are a plurality of heating bars 17.

The detection and control unit includes the thermocouple 13 mounted on the point cooling unit housing 14 and a controller 18 electrically connected to the thermocouple 13, the valve 23 and the driving device 7 to detect the temperature of each hot point on the moving die 4 according to the thermocouple 13 and to adjust opening and closing of the valve 23.

The adopted temperature control algorithm can be PID, fuzzy algorithm, neural network and so on. The functions of the controller 18 include receiving a temperature signal and sending a control signal to the ball valve 23, timing function during the cooling-heating cycle, and sending a control signal for mold opening and mold closing to the driving device 7.

In order to filter impurities in the cooling water, so that the water can be recycled, a filter 21 is provided between the cooling water tank 20 and the water pump 22.

In order to preheat the moving die 4 uniformly by the heating bar 17 and cool the moving die 4 uniformly, the depth of the heating bar mounting hole 26 is 50%-90% of the thickness of the moving die 4, and the depth of the point cooling unit mounting hole 27 is 60%-90% of the thickness of the moving die 4. There are eight heating bar mounting holes 26 which are symmetrically and uniformly distributed on the upper surface of the moving die 4. There are six mounting holes 27 for the point cooling unit, which are symmetrically and evenly distributed on the upper surface of the moving die 4. The number of specific heating bar mounting holes 26 and mounting holes 27 for the point cooling unit can also be set according to actual needs. The number of mounting holes for the point cooling unit is greater than or equal to the number of actually installed point cooling devices. Different cooling sites can be selected for cooling before each test.

Figure 6:
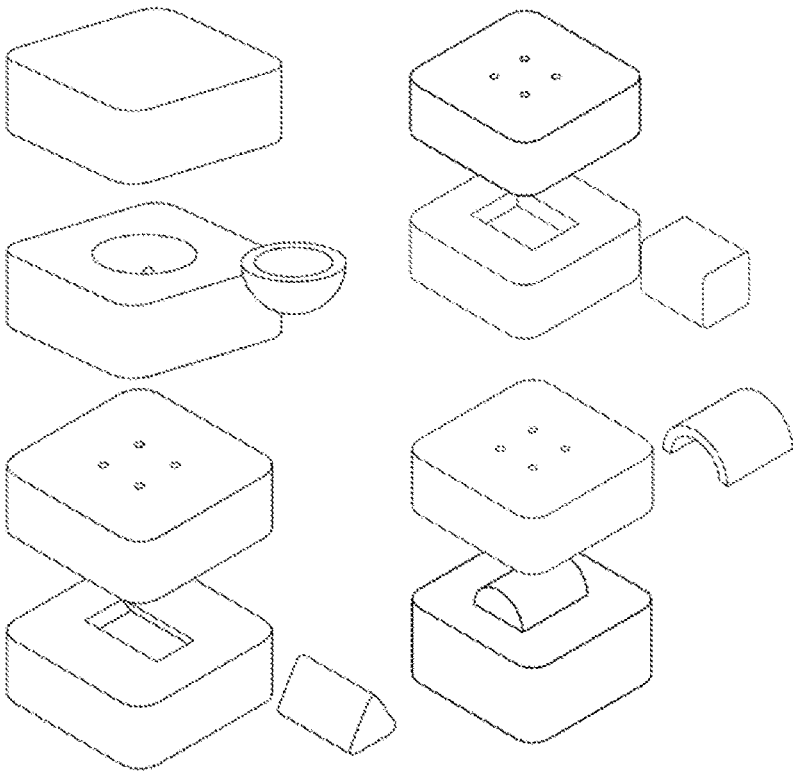
FIG. 6 is a structural schematic diagram of various heating block mounting boxes 3 and heating blocks 9.

In order to be able to simulate the cooling process of molds of different shapes of die cast pieces, so that the testing machine of the present application is well adapted, the heating block 9 can be designed as a tile, triangular prism, cuboid or spherical housing or the like, as required; meanwhile the cavity of the heating block mounting box (3) in which the heating block (9) is placed for the moving die (4) and the stationary die (2) fits the shape of the heating block (9), as shown in FIG. 6

The die casting mold cooling solution of the present application includes two aspects, one is the arrangement of the cooling sites and the other is the selection of the cooling water flow control solution. A heating-cooling cycle process is applied to the test bench, and the number and time of cycles required to reach thermal equilibrium is an important parameter for evaluating the current cooling solution. Difference numbers and locations of the cooling site arrangement, or the different choices of the algorithm for temperature control will all affect the final cooling effect.

The testing machine of the present application simulating the die casting cooling process works as follows:

S1: preheating the moving die 4 to 150° C.-180° C.,

S2: placing the heating block 9 outside the test bench, and placing it with a clamping device in the heating coil 8 to heat for a certain period of time $T_c$, placing the heated heating block 9 in the cavity between the moving die 4 and stationary die 2, and the driving device 7 driving the moving die 4 for mold closing;

S3: introducing cooling water into the point cooling unit 16 for cooling, and the timer in the controller 18 starting to time; detecting the temperature $t_1$, $t_2$, $t_3$, $t_4$, $t_5$, $t_6$ of each hot spot by the thermocouples 13, and feeding the temperature signals of each point back to the controller 18, taking $t_m$ as the average value of the temperature of each point; the controller 18 giving the control quantity $\Delta u_i$ of each corresponding ball valve 23 according to the difference $\Delta t_i = t_i - t_m (i,j=1, 2, 3 \ldots 6)$ between each signal value and the average value, and the ball valve 23 adjusting the cooling water flow rate of each pipeline in real time to realize the uniform cooling of the moving die 4. when the temperature of each hot spot of the mold is lower than 200° C., the driving device 7 opening the mold, and the ejector rod device 5 ensuring that the heating block 9 is separated from the stationary die; and thereby completing a cooling process.

S4: repeating S1-S3 and recording an average $t_{im}$ of a thermocouple measurement point after completion of each simulation of the die cast cooling process; determining that the die cast cooling simulation process has reached a temperature equilibrium when an error of the average value relative to a previous average value is not greater than a set threshold, and recording the average value of the temperature at this time as $t_M$; ending the test and recording a total time for the simulation process;

S5: further judging whether temperatures of various hot points are uniformly distributed, i.e., whether a temperature difference extremum $\Delta t_{max} = \max|t_j - t_M|$ (j=1, 2, 3 . . . 6) is less than a set threshold; if the temperature difference is less than or equal to the set threshold, determining that the temperatures are relatively uniformly distributed and the cooling effect is good, and recording a total time T for a heating-cooling process as a basis for determining the cooling effect; if the temperature difference extremum $\Delta t_{max}$ is greater than the set threshold, determining that the cooling condition is poor and the current cooling solution is not good enough;

S6: comparing a total heating-cooling cycle time T for a plurality of cooling solutions with the temperature difference extremum $\Delta t_{max}$ less than the set threshold, wherein the cooing solution with a smallest T is an optimal solution.

Those skilled in the art shall understand that, the above description is only preferred examples of the application and is not intended to limit the application. Although the application has been described in detail with reference to the foregoing examples, it will be apparent to those skilled in the art that the technical solutions described in the foregoing examples may be modified or equivalents may be substituted for some of the technical features thereof. Modifications, equivalents, and the like within the spirit and principles of the application are intended to be included within the scope of the application.

What is claimed is:

1. A testing machine for simulating a die casting cooling process, the testing machine comprises a mold, a cooling unit, a heating unit, and a detection and control unit, wherein the mold comprises a base (1), a stationary die (2), a moving die (4), a screw (6), an ejector rod device (5), a driving device (7) and a heating block mounting box (3); the stationary die (2) is fixed to the base (1), the moving die (4) is located directly above the stationary die (2), a cavity in which the heating block mounting box (3) is placed is provided between opposite faces of the moving die (4) and the stationary die (2), the heating block mounting box (3) is divided into an upper part and a lower part, embedded in the moving die (4) and the stationary die (2), respectively, a cavity in which a heating block (9) is placed is provided inside the heating block mounting box (3), an upper surface of the moving die (4) is provided with an ejector rod through hole (24), a screw through hole (25), a heating bar mounting hole (26) and a point cooling unit mounting hole (27), the screw (6) extends through the moving die (4), with one end fixed to the stationary die (2) and the other end fixed to the driving device (7), a top end of the ejector rod device (5) is connected to the driving device (7) and extends through the moving die (4) and the upper part of the heating block mounting box (3);

the cooling unit comprises a cooler (19), a cooling water tank (20), a water pump (22), a valve (23) and a point cooling unit (16), the point cooling unit (16) is mounted in the point cooling unit mounting hole (27), and the point cooling unit (16), the cooler (19), the cooling water tank (20) and the water pump (22) are connected in sequence to form a cooling water circulation circuit;

the heating unit comprises an external heating module which comprises a heating block (9) and a heating coil (8), and an internal pre-heating module which comprises a heating bar (17) mounted in the heating bar mounting hole (26); and the detection and control unit comprises a thermocouple (13) mounted on a point cooling unit housing (14) and a controller (18) electrically connected to the thermocouple (13), the valve (23) and the driving device (7) to detect a temperature of each hot point on the moving die (4) according to the thermocouple (13) and to adjust opening and closing of the valve (23).

2. The testing machine for simulating a die casting cooling process according to claim 1, wherein the cooling unit further comprises a filter (21) arranged between the cooling water tank (20) and the water pump (22).

3. The testing machine for simulating a die casting cooling process according to claim 1, wherein a depth of the heating bar mounting hole (26) is 50%-90% of a thickness of the moving die (4) and a depth of the point cooling unit mounting hole (27) is 60%-90% of a thickness of the moving die (4).

4. The testing machine for simulating a die casting cooling process according to claim 1, wherein there are a plurality of heating bar mounting holes (26) that are symmetrically and uniformly distributed on the upper surface of the moving die (4).

5. The testing machine for simulating a die casting cooling process according to claim 1, wherein there are a plurality of point cooling unit mounting holes (27) that are symmetrically and uniformly distributed on the upper surface of the moving die (4).

6. The testing machine for simulating a die casting cooling process according to claim 1, wherein the heating block (9) is a tile-shaped, triangular prism-shaped, cuboid or spherical housing, and the cavity of the heating block mounting box (3) in which the heating block (9) is placed between the moving die (4) and the stationary die (2) fits the shape of the heating block (9).

7. A method for controlling the testing machine for simulating a die casting cooling process according to claim 1, specifically comprising the following steps:

S1: preheating the moving die (4) to 150-180° C.;

S2: placing the heating block (9) in the heating coil (8) to heat for a certain period of time, placing the heated heating block (9) in the cavity of the stationary die (2), and the driving device (7) driving the moving die (4) for mold closing;

S3: the thermocouple (13) monitoring in real time the temperature of each measured point of the moving die (4), the cooling water circulation circuit cooling the moving die (4), calculating an average value of the temperature of each measured point, and the controller (18) controlling the driving device (7) to lift the moving die (4) along the screw (6) when the average value is lower than 200° C.; after the moving die (4) is raised to a highest position, the driving device (7) driving the ejector rod (5) to eject the heating block (9); and thereby completing simulation of a die casting cooling process;

S4: repeating S1-S3 and recording an average $t_{im}$ of a thermocouple measurement point after completion of each simulation of the die cast cooling process;

determining that the die cast cooling simulation process has reached a temperature equilibrium when an error of the average value relative to a previous average value is not greater than a set threshold, and recording the average value of the temperature at this time as $t_M$; ending the test and recording a total time for the simulation process;

S5: further judging whether a temperature difference extremum $\Delta t_{max}=\max|t_j-t_M|$ (j=1, 2, 3 . . . 6) less than a set threshold to determine whether temperatures of various hot points are uniformly distributed; if the temperature difference is less than or equal to the set threshold, determining that the temperatures are relatively uniformly distributed, and recording a total time T for a heating-cooling process as a basis for determining a cooling effect; if the temperature difference extremum $\Delta t_{max}$ is greater than the set threshold, determining that the temperatures are non-uniformly distributed;

S6: comparing a total heating-cooling cycle time T for a plurality of cooling solutions with the temperature difference extremum $\Delta t_{max}$ less than the set threshold, wherein the cooing solution with a smallest T is an optimal solution.

* * * * *